US009721534B2

(12) United States Patent
Liu et al.

(10) Patent No.: US 9,721,534 B2
(45) Date of Patent: Aug. 1, 2017

(54) DISPLAY APPARATUS AND METHOD FOR CONTROLLING BACKLIGHT MODULE THEREOF

(71) Applicants: Chin-Ku Liu, Hsin-Chu (TW); Jhong-Hao Wu, Hsin-Chu (TW)

(72) Inventors: Chin-Ku Liu, Hsin-Chu (TW); Jhong-Hao Wu, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 52 days.

(21) Appl. No.: 14/709,496

(22) Filed: May 12, 2015

(65) Prior Publication Data

US 2016/0027408 A1 Jan. 28, 2016

(30) Foreign Application Priority Data

Jul. 24, 2014 (CN) ..... 2014 1 0354608

(51) Int. Cl.
*G09G 5/10* (2006.01)
*G09G 5/00* (2006.01)
(Continued)

(52) U.S. Cl.
CPC ..... *G09G 5/10* (2013.01); *G09G 3/3413* (2013.01); *G09G 5/00* (2013.01); *G09G 5/026* (2013.01);
(Continued)

(58) Field of Classification Search
CPC .. G09G 3/3413; G09G 5/026; G09G 2320/06; G09G 2320/0613;
(Continued)

(56) References Cited

U.S. PATENT DOCUMENTS 7,135,664 B2 * 11/2006 Vornsand ..... H05B 33/0869 250/205
2004/0119679 A1 6/2004 Garcia et al.
(Continued)

FOREIGN PATENT DOCUMENTS

CN 101614351 12/2009
CN 202206608 4/2012
(Continued)

OTHER PUBLICATIONS

"Office Action of China Counterpart Application," issued on May 24, 2017, p. 1-p. 8.

*Primary Examiner* — Yuzhen Shen
(74) *Attorney, Agent, or Firm* — Jianq Chyun IP Office

(57) ABSTRACT

A display apparatus and a method for controlling a backlight module thereof are provided. The display apparatus includes the backlight module, an input unit and a processing unit. A light-emitting device of the backlight module includes a first light-emitting unit and a second light-emitting unit. A photoelectric conversion efficiency of the first light-emitting unit is higher than that of the second light-emitting unit, and a covering color gamut of the second light-emitting unit is larger than that of the first light-emitting unit. The input unit generates an input signal. The processing unit is coupled to the input unit and configured to receive the input signal generated by the input unit, and the processing unit is coupled to the backlight module, and dynamically adjusts respective light intensity ratios of the first light-emitting unit and the second light-emitting unit according to the received input signal.

15 Claims, 6 Drawing Sheets

(51) Int. Cl.
*G09G 3/34* (2006.01)
*G09G 5/02* (2006.01)

(52) U.S. Cl.
CPC ..... *G09G 2320/0613* (2013.01); *G09G 2320/0626* (2013.01); *G09G 2320/0633* (2013.01); *G09G 2320/0646* (2013.01)

(58) Field of Classification Search
CPC ..... G09G 2320/062; G09G 2320/0626; G09G 2320/0633; G09G 2320/064
USPC ..... 345/690
See application file for complete search history.

(56) References Cited

U.S. PATENT DOCUMENTS

2006/0001641 A1* 1/2006 Degwekar ..... G09G 3/3406 345/102
2007/0103934 A1* 5/2007 Keh ..... G02B 6/0068 362/612
2007/0132680 A1* 6/2007 Kagawa ..... G09G 3/3406 345/84
2008/0165102 A1 7/2008 Tsai et al.
2009/0267879 A1* 10/2009 Masuda ..... G09G 3/3413 345/88
2012/0287142 A1* 11/2012 Fleck ..... G09G 3/3413 345/589
2014/0292834 A1* 10/2014 Ando ..... G09G 3/20 345/690
2015/0015621 A1* 1/2015 Atkinson ..... G09G 3/3413 345/690
2015/0091933 A1* 4/2015 Jayaramaiah ..... G06F 3/0481 345/589

FOREIGN PATENT DOCUMENTS

| | | |
|---|---|---|
| CN | 203395793 | 1/2014 |
| CN | 103680420 | 3/2014 |
| CN | 104751805 | 7/2015 |
| TW | 200815864 | 4/2008 |
| TW | 201024863 | 7/2010 |
| TW | M457891 | 7/2013 |
| WO | 2013137906 | 9/2013 |

* cited by examiner

DISPLAY APPARATUS AND METHOD FOR CONTROLLING BACKLIGHT MODULE THEREOF

CROSS-REFERENCE TO RELATED APPLICATION

This application claims the priority benefit of Chinese application serial no. 201410354608.4, filed on Jul. 24, 2014. The entirety of the above-mentioned patent application is hereby incorporated by reference herein and made a part of this specification.

BACKGROUND

Technical Field

The invention relates to a display technique, and particularly relates to a display apparatus implementing display by using light-emitting units having different photoelectric conversion efficiencies and covering color gamuts, and a method for controlling a backlight module thereof.

Related Art

A general liquid crystal display (LCD) is mainly composed of a backlight module and a liquid crystal panel. Since the liquid crystal panel itself does not emit light, the backlight module is required to provide a planar light source required for displaying, so as to present image containing various colors.

The LCD installed on a mobile device is portable, and a usage environment thereof is not fixed. For example, when the mobile device is used outdoors or used under a strong sunlight, the user hopes that the LCD on the mobile device is capable of increasing a screen brightness to avoid unclear display of images, and when the user uses the mobile device in a dark environment, the user hopes that the LCD on the mobile device is capable of automatically decreasing a screen brightness to avoid over bright of the screen to hurt user's eyes.

However, generally, the existing display apparatus can only adjust a display brightness of the backlight module, and cannot adjust a display chroma (a display color gamut) of the backlight module. In other words, when the user hopes the screen of the mobile device to be more colourful, the mobile device and the applications installed on the mobile device cannot implement color gamut adjustment by using hardware equipment on the mobile device. Moreover, regarding light-emitting diodes (LEDs) currently used for providing the brightness of the backlight module, limited by a material characteristic, a photoelectric conversion efficiency of the LEDs with larger covering color gamut is lower than a photoelectric conversion efficiency of the LEDs with smaller covering color gamut, and if the light sources of the backlight module are all the LEDs with larger covering color gamut in order to satisfy the user's demand on more colourful screen of the mobile device, power consumption of the light-emitting unit is increased and a usage time of the mobile device is decreased, such that user's requirement for prolonging the usage time of the mobile device cannot be achieved.

Therefore, it is an important issue to ensure the display apparatus to efficiently implement free adjustment on image brightness and color performance under different situations, so as to suitably decease power consumption of the light-emitting unit and hardware cost.

Taiwan Patent Publication No. 201024863 discloses a backlight module having two light-emitting units respectively operated in different color gamuts, where each of the light-emitting units has at least one light-emitting diode, and the two light-emitting units are used in collaboration to achieve a larger color gamut performance of the display apparatus. Taiwan Patent No. M457891 discloses an LED light bar capable of providing a high brightness or a low brightness according to the number of used LEDs. China Patent No. 202206608 discloses an illumination control apparatus capable of automatically adjusting electric energy supplied to a load according to total electric quantity. China Patent No. 203395793 discloses a solar LED street lamp capable of continuously lighting a first LED light source with a lower power, and when a pedestrian comes up, the city power is supplied to a second LED light source for lighting, such that the first LED light source and the second LED light soured simultaneously emit light to improve an illumination brightness.

The information disclosed in this Background section is only for enhancement of understanding of the background of the described technology and therefore it may contain information that does not form the prior art that is already known to a person of ordinary skill in the art. Further, the information disclosed in the Background section does not mean that one or more problems to be resolved by one or more embodiments of the invention was acknowledged by a person of ordinary skill in the art.

SUMMARY

The invention is directed to a display apparatus and a method for controlling a backlight module thereof, where the backlight module of the display apparatus has at least two light-emitting units with different photoelectric conversion efficiencies and covering color gamuts, a light intensity ratio of each of the light-emitting units is dynamically adjusted according to a status of the display apparatus, so as to maintain quality of a display image according to user's requirement while balancing image brightness and color performance.

Other objects and advantages of the invention can be further illustrated by the technical features broadly embodied and described as follows.

In order to achieve one or a portion of or all of the objects or other objects, an embodiment of the invention provides a display apparatus. The display apparatus includes a backlight module, an input unit and a processing unit. A light-emitting device of the backlight module includes a first light-emitting unit and a second light-emitting unit. A photoelectric conversion efficiency of the first light-emitting unit is higher than a photoelectric conversion efficiency of the second light-emitting unit, and a covering color gamut of the second light-emitting unit is larger than a covering color gamut of the first light-emitting unit. The input unit generates an input signal. The processing unit is coupled to the input unit and configured to receive the input signal generated by the input unit. The processing unit is further coupled to the backlight module, and dynamically adjusts respective light intensity ratios of the first light-emitting unit and the second light-emitting unit according to the received input signal.

In an embodiment of the invention, the display apparatus further includes a storage unit, which is coupled to the processing unit and configured to store at least one light intensity mode information. Each light intensity mode information includes respective predetermined light intensity ratios of the first light-emitting unit and the second light-emitting unit.

In an embodiment of the invention, the display apparatus is disposed in an electronic device, and the electronic device includes at least one application. The input unit is a data comparison module. When the electronic device executes the application, the data comparison module determines a display content of the application, and generates the input signal according to a determination result. The processing unit selects at least one corresponding light intensity mode according to the input signal, and adjusts the respective light intensity ratios of the first light-emitting unit and the second light-emitting unit according to the at least one corresponding light intensity mode.

In an embodiment of the invention, each of the applications in the electronic device respectively sets a light intensity mode flag, and the input signal includes the light intensity mode flag corresponding to one of the applications, and the processing unit selects the at least one corresponding light intensity mode according to the light intensity mode flag of the input signal.

In an embodiment of the invention, when the display content of the application mainly includes text information, the processing unit adjusts the light intensity ratio of the first light-emitting unit to the maximum, and adjusts the light intensity ratio of the second light-emitting unit to the minimum.

In an embodiment of the invention, when the display content of the application mainly includes image information, the processing unit adjusts the light intensity ratio of the first light-emitting unit to the minimum, and adjusts the light intensity ratio of the second light-emitting unit to the maximum.

In an embodiment of the invention, the input unit is a brightness determination module, and the brightness determination module provides brightness information of the backlight module to serve as the input signal. The processing unit receives the brightness information, and when the brightness information is lower than a brightness predetermined value, the processing unit adjusts the light intensity ratio of the second light-emitting unit to serve as a brightness of the backlight module, and disables the first light-emitting unit; and when the brightness information is higher than the brightness predetermined value, the processing unit adjusts the light intensity ratio of the second light-emitting unit to the maximum, and dynamically adjusts the light intensity ratio of the first light-emitting unit to serve as the brightness of the backlight module.

In an embodiment of the invention, the input unit is an electric quantity monitoring module of the display apparatus, which is configured to generate electric quantity information of the display apparatus to serve as the input signal, where the processing unit receives the electric quantity information, and when the electric quantity information is lower than an electric quantity predetermined value, the processing unit adjusts the light intensity ratio of the first light-emitting unit to serve as a brightness of the backlight module, and disables the second light-emitting unit.

In an embodiment of the invention, the input unit is a display brightness-chroma adjusting module, which is configured to provide ratio information between a display brightness and a display chroma to serve as the input signal, where the processing unit receives the ratio information, and makes a proportion between the light intensity ratios of the first light-emitting unit and the second light-emitting unit to be equal to the ratio information.

In order to achieve one or a portion of or all of the objects or other objects, an embodiment of the invention provides a method for controlling a backlight module, which includes following steps. An input signal generated by an input unit is received, and respective light intensity ratios of a first light-emitting unit and a second light-emitting unit are dynamically adjusted according to the received input signal, where the backlight module includes the first light-emitting unit and the second light-emitting unit. A photoelectric conversion efficiency of the first light-emitting unit is higher than a photoelectric conversion efficiency of the second light-emitting unit, and a covering color gamut of the second light-emitting unit is larger than a covering color gamut of the first light-emitting unit.

In an embodiment of the invention, the backlight module is disposed in an electronic device, and the step of dynamically adjusting the respective light intensity ratios of the first light-emitting unit and the second light-emitting unit includes following steps. When the electronic device executes an application, a display content of the application is determined to generate the input signal; at least one corresponding light intensity mode is selected according to the input signal; and the respective light intensity ratios of the first light-emitting unit and the second light-emitting unit are adjusted according to the at least one corresponding light intensity mode. Each of the at least one light intensity mode information includes respective predetermined light intensity ratios of the first light-emitting unit and the second light-emitting unit.

In an embodiment of the invention, each of the applications in the electronic device respectively sets a light intensity mode flag, and the input signal includes the light intensity mode flag corresponding to the application. The step of selecting the at least one corresponding light intensity mode according to the input signal includes following steps. The at least one corresponding light intensity mode is selected according to the light intensity mode flag of the input signal.

In an embodiment of the invention, the step of adjusting the respective light intensity ratios of the first light-emitting unit and the second light-emitting unit includes following steps. When the display content of the application mainly includes text information, the light intensity ratio of the first light-emitting unit is adjusted to the maximum, and the light intensity ratio of the second light-emitting unit is adjusted to the minimum; and when the display content of the application mainly includes image information, the light intensity ratio of the first light-emitting unit is adjusted to the minimum, and the light intensity ratio of the second light-emitting unit is adjusted to the maximum.

In an embodiment of the invention, the input signal is brightness information of the backlight module, and the step of dynamically adjusting the respective light intensity ratios of the first light-emitting unit and the second light-emitting unit includes following steps. When the brightness information is lower than a brightness predetermined value, the light intensity ratio of the second light-emitting unit is adjusted to serve as a brightness of the backlight module, and the first light-emitting unit is disabled.

In an embodiment of the invention, the input signal is brightness information of the backlight module, and the step of dynamically adjusting the respective light intensity ratios of the first light-emitting unit and the second light-emitting unit includes following steps. When the brightness information is higher than the brightness predetermined value, the light intensity ratio of the second light-emitting unit is adjusted to the maximum, and the light intensity ratio of the first light-emitting unit is dynamically adjusted to serve as the brightness of the backlight module.

In an embodiment of the invention, the input signal is electric quantity information of the backlight module, and the step of dynamically adjusting the respective light intensity ratios of the first light-emitting unit and the second light-emitting unit includes following steps. When the electric quantity information is lower than an electric quantity predetermined value, the light intensity ratio of the first light-emitting unit is adjusted to serve as a brightness of the backlight module, and the second light-emitting unit is disabled.

In an embodiment of the invention, the input signal is ratio information between a display brightness and a display chroma, and the step of dynamically adjusting the respective light intensity ratios of the first light-emitting unit and the second light-emitting unit includes following steps. The ratio information is received, and a proportion between the light intensity ratios of the first light-emitting unit and the second light-emitting unit is made to be equal to the ratio information.

According to the above information, the display apparatus and the backlight module thereof can dynamically adjust light intensity ratios of at least two light-emitting units with different photoelectric conversion efficiencies and covering color gamuts according to applications of the display apparatus, environmental brightness, remaining power and user's preference, etc. In this way, the display apparatus is capable of effectively adjusting the image brightness and color performance in allusion to different usage situations, so as to suitably decrease the power consumption of the light-emitting units and the hardware cost.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
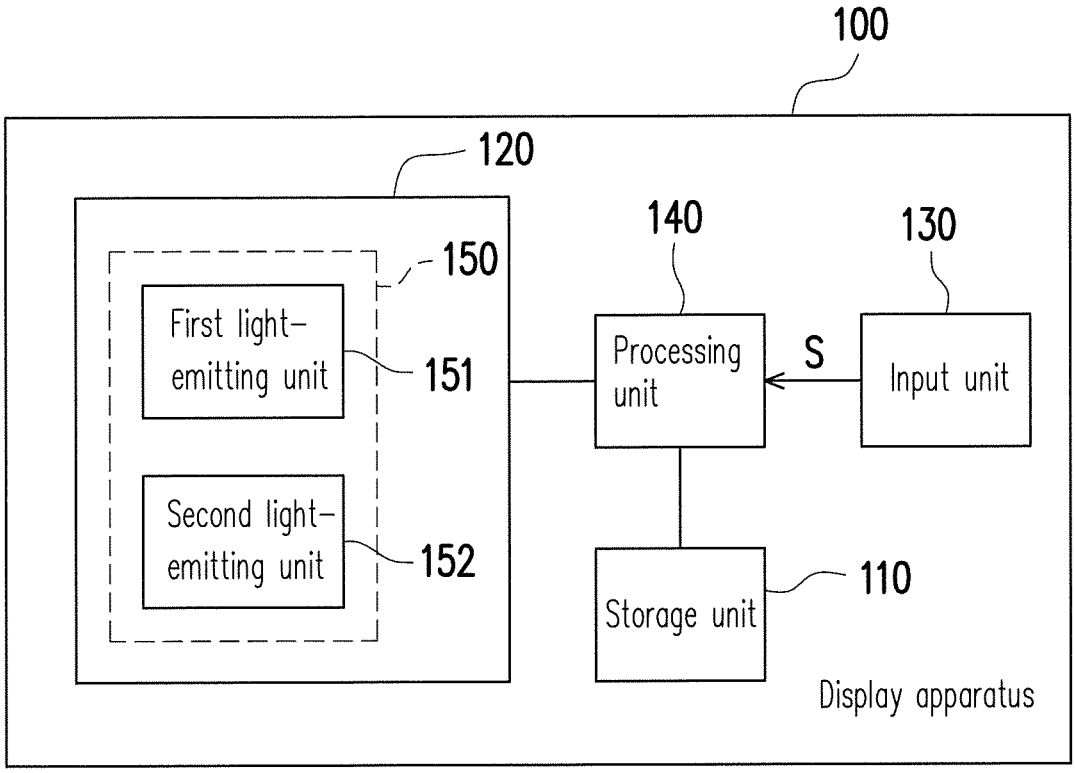
FIG. 1 is a block diagram of a display apparatus according to an embodiment of the invention.

FIG. 1 is a block diagram of a display apparatus according to an embodiment of the invention. Referring to FIG. 1, the display apparatus 100 includes a backlight module 120, an input unit 130 and a processing unit 140. The backlight module 120 includes a light-emitting device 150. The light-emitting device 150 includes a first light-emitting unit 151 and a second light-emitting unit 152. A photoelectric conversion efficiency of the first light-emitting unit 151 is higher than a photoelectric conversion efficiency of the second light-emitting unit 152, and a covering color gamut of the second light-emitting unit 152 is larger than a covering color gamut of the first light-emitting unit 151. The so-called higher photoelectric conversion efficiency refers to that the light-emitting unit has a higher display brightness under a same driving current. In the embodiment, the first light-emitting unit 151 with higher photoelectric conversion efficiency is, for example, an yttrium aluminium garnet (YAG) phosphor powder packaged light-emitting diode (LED), though the invention is not limited thereto. Moreover, the so-called larger covering color gamut represents a higher ratio between a displayable color range of the light-emitting unit and a color range specified by the national television system committee (NTSC). In the embodiment, the second light-emitting unit 152 with larger covering color gamut is, for example, an RGh2 packaged LED, though the invention is not limited thereto.

Figure 2A:
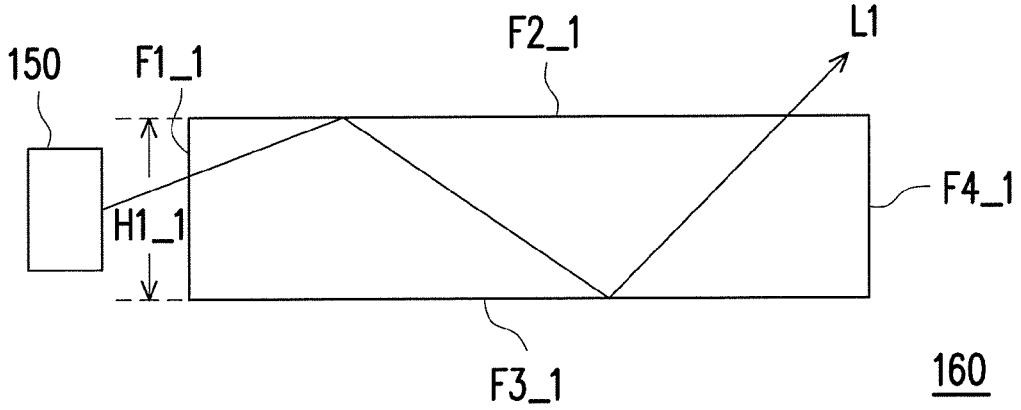
FIGS. 2A-2C are schematic diagrams of light guide plates (LGPs) according to an embodiment of the invention.
Figure 2B:
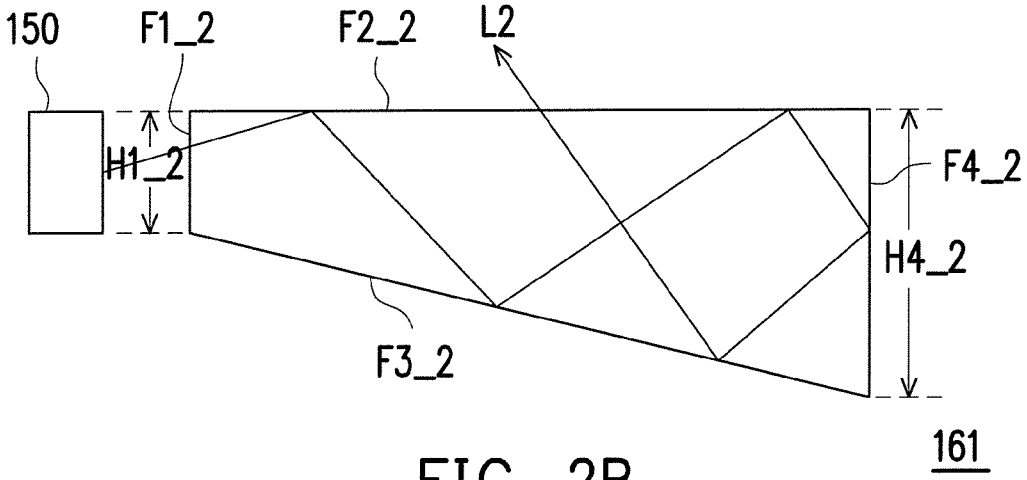
Figure 2C:
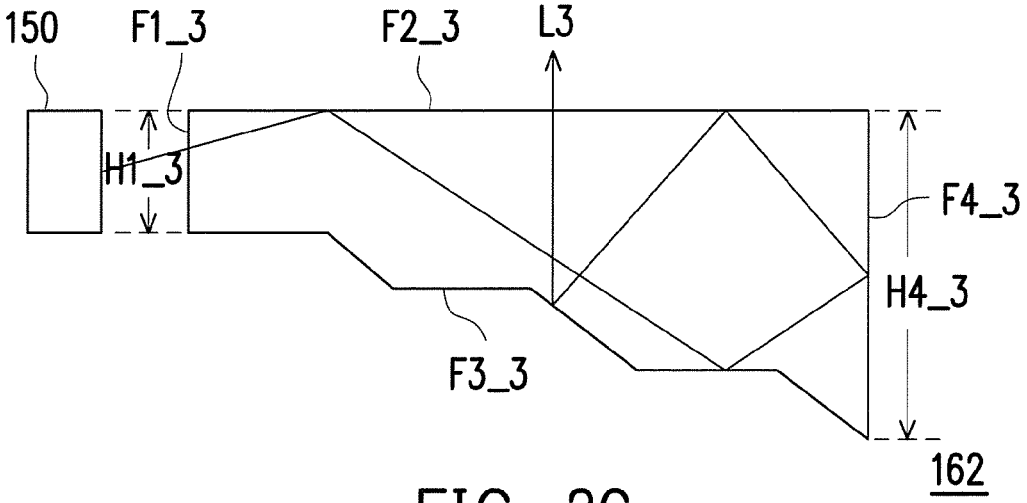

In FIG. 1, besides the light-emitting device 150, the backlight module 120 further includes a light guide plate (LGP), and types of the LGP are described below. FIGS. 2A-2C are schematic diagrams of LGPs according to an embodiment of the invention. Referring to FIG. 2A, in an embodiment of the invention, the LGP 160 is, for example, a general LGP, which includes a light incident surface F1_1, a light-emitting surface F2_1, a reflection surface F3_1 and a side surface F4_1. The light-emitting device 150 is disposed at a side of the light incident surface F1_1, and emits a beam L1 to enter the LGP 160 through the light incident surface F1_1. The beam L1 is reflected by the reflection surface F3_1 or the side surface F4_1 and emits out through the light-emitting surface F2_1, so as to irradiate a liquid crystal panel to display image. The reflection surface F3_1 and the light-emitting surface F2_1 are opposite and parallel to each other, in other words, a thickness H1_1 of the LGP 160 is constant value.

Referring to FIG. 2B, in another embodiment of the invention, the LGP 161 is, for example, reflective wedge-shaped LGP, which includes a light incident surface F1_2, a light-emitting surface F2_2, a reflection surface F3_2 and a side surface F4_2. The light-emitting device 150 is disposed at a side of the light incident surface F1_2, and emits a beam L2 to enter the LGP 161 through the light incident surface F1_2. The beam L2 is reflected by the reflection surface F3_2 or the side surface F4_2 and emits out through the light-emitting surface F2_2, so as to irradiate the liquid crystal panel to display image. A thickness H4_2 of the LGP 161 at the side surface F4_2 is greater than a thickness H1_2 of the LGP 161 at the light incident surface F1_2, and the thickness of the LGP 161 is gradually decreased along a direction from the side surface F4_2 to the light incident surface F1_2.

Referring to FIG. 2C, in another embodiment of the invention, the LGP 162 is, for example, a step type LGP, which includes a light incident surface F1_3, a light-emitting surface F2_3, a step type reflection surface F3_3 and a side surface F4_3. The light-emitting device 150 is disposed at a side of the light incident surface F1_3, and emits a beam L3 to enter the LGP 162 through the light incident surface F1_3. The beam L3 is reflected by the step type reflection surface F3_3 or the side surface F4_3 and emits out through the light-emitting surface F2_3, so as to irradiate the liquid crystal panel to display image. A thickness H4_3 of the LGP 162 at the side surface F4_3 is greater than a thickness H1_3 of the LGP 162 at the light incident surface F1_3, and a part of the thickness of the LGP 162 is the same along a direction from the side surface F4_3 to the light incident surface F1_3. In the above embodiment, although some types of the LGP (the general LGP, the reflective wedge-shaped LGP and the step type LGP) of FIGS. 2A-2C are introduced, the invention is not limited thereto.

Referring to FIG. 1, the input unit 130 is, for example, an electronic device capable of generating an input signal S according to a state of the display apparatus 100, an integrated circuit (IC) containing specific software, firmware or functions, a sensor, an inductor, a detector or a touch module, though the invention is not limited thereto. Functions, types and an operation flow of the input unit 130 are introduced later with reference of various embodiments.

In FIG. 1, the processing unit 140 is, for example, a central processing unit (CPU), a programmable general purpose or special purpose microprocessor, a digital signal processor (DSP), a programmable controller, application specific integrated circuits (ASIC), a programmable logic device (PLD), or other similar devices or a combination of the above device. The processing unit 140 is coupled to the input unit 130 and the backlight module 120, for example, coupled to a light source circuit board of the backlight module 120, and dynamically adjusts respective light intensity ratios of the first light-emitting unit 151 and the second light-emitting unit 152 according to the received input signal S. For example, the processing unit 140 can adjust driving currents of the first light-emitting unit 151 and the second light-emitting unit 152 by using a pulse width modulation (PWM) signal, so as to change the respective light intensity ratios of the first light-emitting unit 151 and the second light-emitting unit 152, though the invention is not limited thereto.

Figure 3:
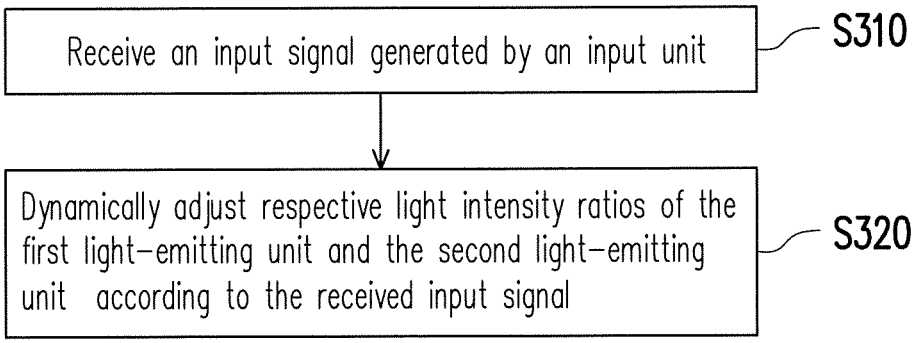
FIG. 3 is a flowchart illustrating a method for controlling a backlight module according to an embodiment of the invention.

FIG. 3 is a flowchart illustrating a method for controlling a backlight module according to an embodiment of the invention. Referring to FIG. 1 and FIG. 3, the method for controlling the backlight module of the embodiment is adapted to the display apparatus 100 of FIG. 1, and various steps of the method for controlling the backlight module are introduced below with reference of various components of the display apparatus 100.

In the step S310, the processing unit 140 receives the input signal S generated by the input unit 130. In detail, the input unit 130 can generate the input signal S according to the state of the display apparatus 100, and transmits the input signal S to the processing unit 140, and the processing unit 140 receives the input signal S. In step S320, the processing unit 140 dynamically adjusts the respective light intensity ratios of the first light-emitting unit 151 and the second light-emitting unit 152 according to the received input signal S. In detail, the processing unit 140 can adjust driving currents of the first light-emitting unit 151 and the second light-emitting unit 152 according to the input signal S by using a PWM signal (or other similar approaches), so as to adjust the respective light intensity ratios of the first light-emitting unit 151 with higher photoelectric conversion efficiency and the second light-emitting unit 152 with larger covering color gamut.

In order to describe the invention in detail, an operation flow of the display apparatus and the backlight module thereof are introduced below with reference of various functions of the input unit 130.

Figure 4:
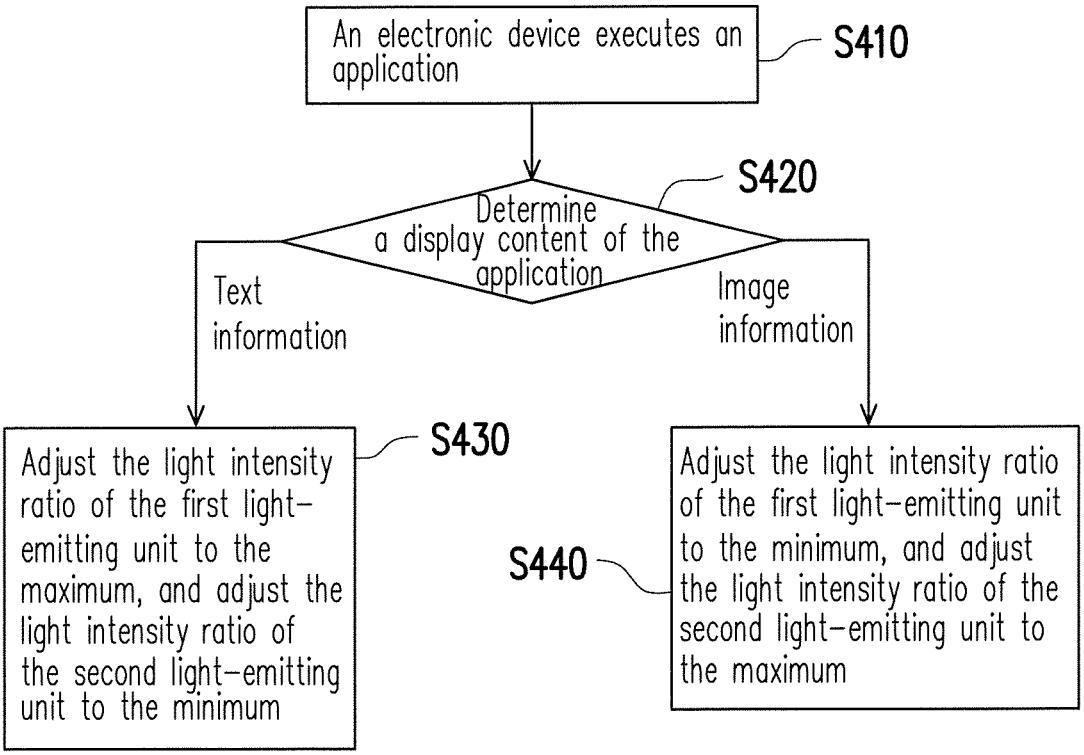
FIG. 4 is a flowchart illustrating a method for controlling a backlight module according to another embodiment of the invention.

FIG. 4 is a flowchart illustrating a method for controlling a backlight module according to another embodiment of the invention. Referring to FIG. 1 and FIG. 4, for example, the input unit 130 determines a type of an application executed by an electronic device installed with the display apparatus 100. The input unit 130 determines the type of the application to generate the input signal S, for example, the determination is performed according to a file name or an extension name or by using other software (for example, TrID) used for determining application types, such that the processing unit 140 can adjust the respective light intensity ratios of the light-emitting units according to different application types.

The method for controlling the backlight module of the embodiment is adapted to the display apparatus 100 of FIG. 1. In the embodiment, the display apparatus 100 is disposed in an electronic device. The electronic device is, for example, a handheld mobile device such as a smart phone, a personal digital assistance (PDA), a PDA phone, a notebook or a tablet PC, etc. The input unit 130 is, for example, a data comparison module in the embodiment, and includes an IC containing software or firmware capable of determining a file name or an extension name of an application or an IC containing software used for determining a type of the application. Moreover, the display apparatus 100 further includes a storage unit 110 coupled to the processing unit 140. The storage unit 110 is, for example, a database, which is used for storing light intensity mode information corresponding to various application types (as shown in following table 1). Each of the light intensity mode information includes light intensity modes adopted by each of the application types, and predetermined light intensity ratios of the first light-emitting unit 151 and the second light-emitting unit 152 under each of the light intensity modes.

TABLE 1

| Light intensity mode | First light-emitting unit (high photoelectric conversion efficiency) | Second light-emitting unit (larger covering color gamut) |
|---|---|---|
| Power saving mode | 100% | 0% |
| Chroma mode | 0% | 100% |

Referring to FIG. 4, in step S410, the electronic device executes an application. In step S420, the input unit 130 determines a display content of the application, and generates the input signal S according to a determination result. In detail, the input unit 130 determines the light intensity mode corresponding to the display content of the application, so as to generate the corresponding input signal S.

In the embodiment, the electronic device has at least a power saving mode and a chroma mode. A color performance of a display image of the power saving mode is less good, though the power consumption of the power saving mode is decreased. Therefore, the power saving mode is adapted to applications requiring less color and a display content thereof mainly includes text information, for example, a webpage browser (for example, Windows Internet Explorer, Google Chrome, etc.), a social network service program (for example, Facebook, Twitter, etc.), an e-mail client program (for example, Microsoft Outlook, Gmail, etc.) or a word processing program (for example, Microsoft Office, Apache OpenOffice, etc.). When the input unit 130 determines that the display content of the application is adapted to the power saving mode, the input unit 130 accordingly generates the input signal S corresponding to the power saving mode.

On the other hand, a display image of the chroma mode has good color performance, and although the power consumption is increased, the user may obtain good image quality. Therefore, the chroma mode is adapted to applications requiring rich color and the display content thereof mainly includes image information, for example, an online video photo sharing program (for example, YouTube, Instagram), video playing software (for example, Windows Media Player) or various games, etc. When the input unit 130 determines that the display content of the application is adapted to the chroma mode, the input unit 130 accordingly generates the input signal S corresponding to the chroma mode.

The processing unit 140 selects the corresponding light intensity mode according to the input signal S, for example, the power saving mode or the chroma mode, and adjusts the respective light intensity ratios of the first light-emitting unit 151 and the second light-emitting unit 151 according to the corresponding light intensity mode. In FIG. 4, when the processing unit 140 receives the input signal S representing the power saving mode, where the power saving mode is adapted to applications requiring less color and the display content thereof mainly includes text information, in step S430, the processing unit 140 adjusts the light intensity ratio of the first light-emitting unit 151 to be greater than the light intensity ratio of the second light-emitting unit 152, for example, the processing unit 140 adjusts the light intensity ratio of the first light-emitting unit 151 to the maximum, and adjusts the light intensity ratio of the second light-emitting unit 152 to the minimum. In an embodiment, the processing unit 140 adjusts the light intensity ratio of the first light-emitting unit 151 to 100% and adjusts the light intensity ratio of the second light-emitting unit 152 to 0% according to the predetermined light intensity ratios (shown in the table 1) recorded in the light intensity information corresponding to the power saving mode that is stored in the storage unit 110. In this way, the first light-emitting unit 151 with smaller covering color gamut and lower power consumption is used to provide a brightness of the backlight module 120, so as to reduce the power consumption of the display apparatus 100 when dealing with the text information.

On the other hand, when the processing unit 140 receives the input signal S representing the chroma mode, where the chroma mode is adapted to applications requiring rich color and the display content thereof mainly includes image information, in step S440, the processing unit 140 adjusts the light intensity ratio of the first light-emitting unit 151 to be smaller than the light intensity ratio of the second light-emitting unit 152, for example, the processing unit 140 adjusts the light intensity ratio of the first light-emitting unit 151 to the minimum, and adjusts the light intensity ratio of the second light-emitting unit 152 to the maximum. In an embodiment, the processing unit 140 adjusts the light intensity ratio of the first light-emitting unit 151 to 0% and adjusts the light intensity ratio of the second light-emitting unit 152 to 100% according to the predetermined light intensity ratios (shown in the table 1) recorded in the light intensity information corresponding to the chroma mode that is stored in the storage unit 110. In this way, the second light-emitting unit 152 with larger covering color gamut and higher power consumption is used to provide the brightness of the backlight module 120, so as to improve image quality when viewing images or videos. It should be noticed that although the light intensity ratios (0% and 100%) recorded in the table 1 are used to describe the power saving mode and the chroma mode, the values of the light intensity ratios are not limited thereto.

In another embodiment, each of the applications in the electronic device may preset a light intensity mode flag. Each of the light intensity mode flags represents the light intensity mode adapted to the corresponding application. When a certain application is executed, the light intensity mode flag corresponding to such application is set, and the input unit 130 adds the set light intensity mode flag to the input signal S, i.e. the input signal S includes the light intensity mode flag corresponding to the application. The processing unit 140 selects the corresponding light intensity mode according to the light intensity mode flag included in the input signal S. In this way, it is unnecessary to determine the display content of the applications one-by-one, and when the executed application is confirmed, the respective light intensity ratios of the first light-emitting unit 151 and the second light-emitting unit 152 are adjusted.

Figure 5:
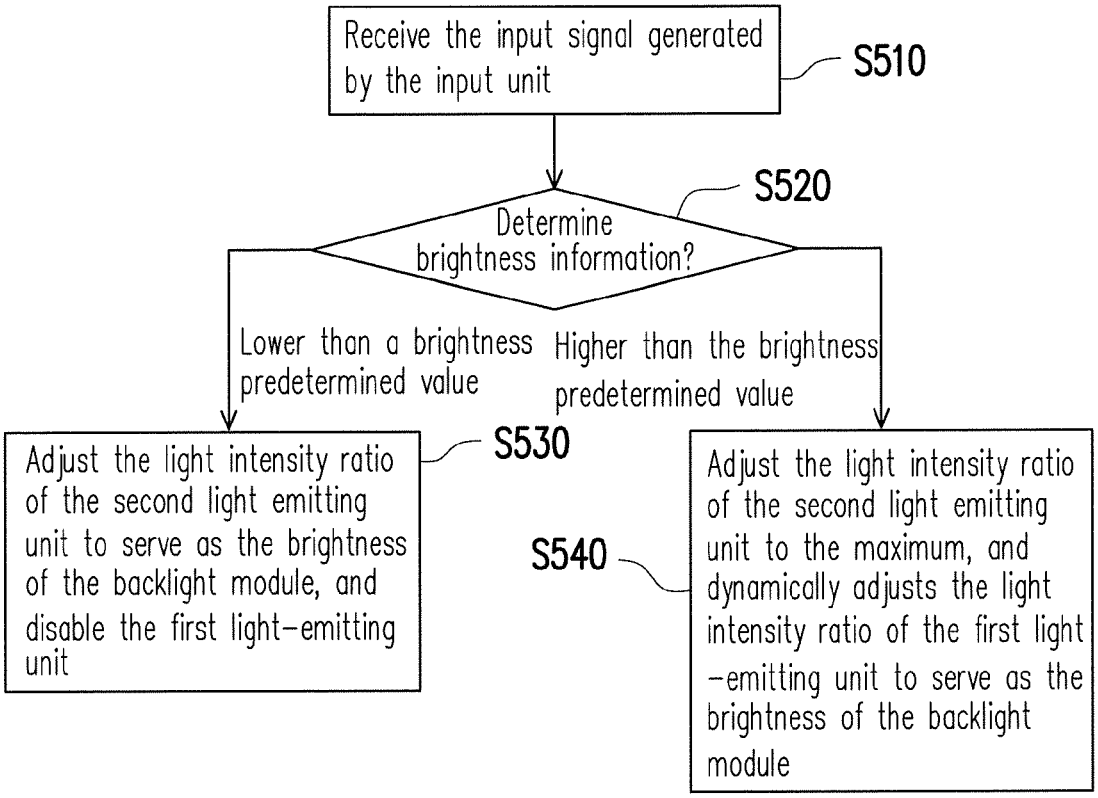
FIG. 5 is a flowchart illustrating a method for controlling a backlight module according to another embodiment of the invention.

FIG. 5 is a flowchart illustrating a method for controlling a backlight module according to another embodiment of the invention. Referring to FIG. 1 and FIG. 5, in the embodiment, the input unit 130 may sense a brightness of an ambient environment. Therefore, the input unit 130 can generate the input signal S according to the brightness of the ambient environment, and the processing unit 140 can adjust the respective light intensity ratio of each of the light-emitting units according to different environment brightness.

The method for controlling the backlight module of the embodiment is adapted to the display apparatus 100 of FIG. 1. In the embodiment, the input unit 130 is a brightness determination module, for example, a photosensing element such as an ambient illuminance sensor, an ambient light sensor, etc. The input unit 130 is used for providing brightness information of the backlight module 120 to serve as the input signal S. Moreover, the display apparatus 100 further includes a storage unit 110 coupled to the processing unit 140. The storage unit 110 stores a brightness predetermined value serving as a comparison reference, and stores the light intensity mode information.

Referring to FIG. 5, in step S510, the processing unit 140 receives the input signal S generated by the input unit 130. In detail, the input unit 130 serving as the brightness determination module determines the brightness of the ambient environment of the display apparatus 100, and provides the brightness information of the ambient environment to serve as the input signal S, and the input unit 130 transmits the input signal S to the processing unit 140, and the processing unit 140 receives the brightness information.

In step S520, the processing unit 140 determines the brightness information in the input signal S. When the brightness information is lower than the brightness predetermined value, in step S530, the processing unit 140 adjusts the light intensity ratio of the second light emitting unit 152 to serve as the brightness of the backlight module 120, and disables the first light-emitting unit 151. In detail, when the brightness information is lower than the brightness predetermined value, it represents that the brightness of the ambient environment of the display apparatus 100 is relative low, and the backlight module 120 is only required to provide a lower brightness in order to clearly display images. Therefore, the processing unit 140 adjusts the light intensity ratio of the second light-emitting unit 152 with lower photoelectric conversion efficiency and larger covering color gamut to serve as the brightness of the backlight module 120, and disables the first light-emitting unit 151 with higher photoelectric conversion efficiency and lower covering color gamut, such that the backlight module 120 can provide higher display chroma in case that the display brightness is not required, so as to improve the color performance of the image.

On the other hand, when the brightness information is higher than the brightness predetermined value, in step S540, the processing unit 140 adjusts the light intensity ratio of the second light emitting unit 152 to the maximum, and dynamically adjusts the light intensity ratio of the first light-emitting unit 151 to serve as the brightness of the backlight module 120. In detail, when the brightness information is higher than the brightness predetermined value, it represents that the brightness of the ambient environment of the display apparatus 100 is relative high, and the backlight module 120 has to provide a higher brightness in order to clearly display images. Therefore, the processing unit 140 adjusts the light intensity ratio of the second light-emitting unit 152 with lower photoelectric conversion efficiency and larger covering color gamut to the maximum, and dynamically adjusts the light intensity ratio of the first light-emitting unit 151 with higher photoelectric conversion efficiency and lower covering color gamut to serve as the brightness of the backlight module 120. Now, the backlight module 120 can increase the display brightness. According to the above method for controlling the backlight module, the light-emitting unit with lower cost and higher photoelectric conversion efficiency and the light-emitting unit with higher cost and larger covering color gamut can be dynamically adjusted to maintain a high quality image, and when the ambient brightness is lower, user's requirement on color performance is satisfied, and when the ambient brightness is higher, prior to the color performance, user's requirement on image brightness is satisfied, by which user's requirements on the display brightness and display chroma are balanced under different ambient environment, so as to decrease the hardware cost.

In another embodiment of the invention, types of the light intensity mode information stored in the storage unit 110 can be arbitrarily increased according to usage environment and use's preference (shown in FIG. 2), where the user mode refers to that the user can set/adjust and store the light intensity ratios of the first light-emitting unit and the second light-emitting unit by himself, though the types of the light intensity mode information are not limited thereto.

TABLE 2

| Light intensity mode | First light-emitting unit (higher photoelectric conversion efficiency) | Second light-emitting unit (larger covering color gamut) |
|---|---|---|
| Sunlight mode | 100% | 100% |
| Movie mode | 20% | 80% |
| Brightness mode | 100% | 50% |
| Display mode | 60% | 40% |
| User mode | 0~100% | 0~100% |

Figure 6:
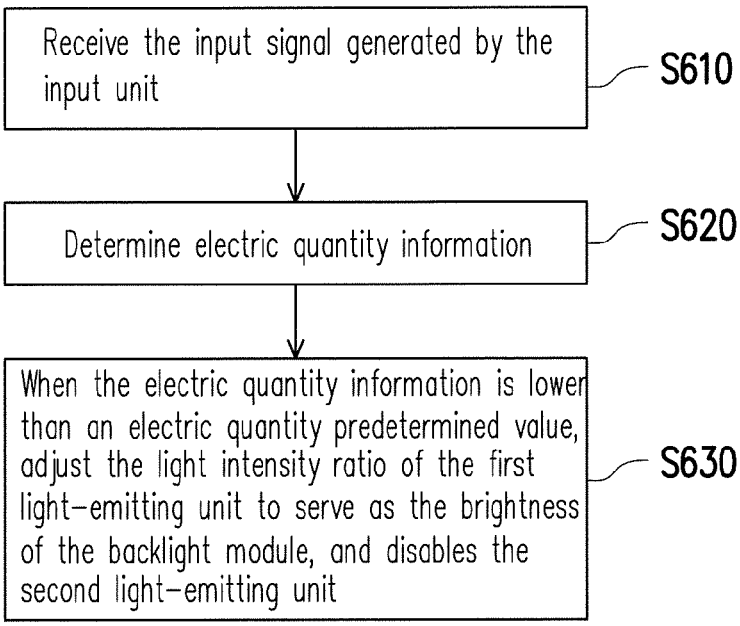
FIG. 6 is a flowchart illustrating a method for controlling a backlight module according to another embodiment of the invention.

FIG. 6 is a flowchart illustrating a method for controlling a backlight module according to another embodiment of the invention. Referring to FIG. 1 and FIG. 6, in the embodiment, the input unit 130 may monitor an electric quantity of the display apparatus 100. Therefore, the input unit 130 generates the input signal S according to a remained electric quantity, and the processing unit 140 can adjust the light intensity ratios of the light-emitting units according to different degrees of the remained electric quantity.

The method for controlling the backlight module of the embodiment is adapted to the display apparatus 100 of FIG. 1. In the embodiment, the display apparatus 100 is, for example, mobile device using a battery to supply power. The input unit 130 is an electric quantity monitoring module of the display apparatus 100, which is, for example, a battery level detector, a battery level detecting IC, etc. The input unit 130 is used for generating electric quantity information of the display apparatus 100 to serve as the input signal S. Moreover, the display apparatus 100 further includes the storage unit 110 coupled to the processing unit 140. The storage unit 110 stores an electric quantity predetermined value serving as a comparison reference.

Referring to FIG. 6, in case that the display apparatus 100 is only powered by the battery, in step S610, the processing unit 140 receives the input signal S generated by the input unit 130. In detail, the input unit 130 serving as the electric quantity monitoring module can determine the remained electric quantity of the display apparatus 100, and generates electric quantity information of the display apparatus 100 to serve as the input signal S. Moreover, the input unit 130 transmits the input signal S to the processing unit 140, and the processing unit 140 receives the electric quantity information.

In step S620, the processing unit 140 determines the electric quantity information in the input signal S to learn the remained electric quantity. When the electric quantity information is lower than the electric quantity predetermined value, in step S630, the processing unit 140 adjusts the light intensity ratio of the first light-emitting unit 151 to serve as the brightness of the backlight module 120, and disables the second light-emitting unit 152. In detail, when the electric quantity information is lower than the electric quantity predetermined value, it represents that the remained electric quantity of the display apparatus 100 is insufficient. Therefore, the processing unit 140 disables the second light-emitting unit 152 with larger covering color gamut and larger power consumption and only uses the first light-emitting unit 151 with higher photoelectric conversion efficiency and lower power consumption as a brightness source of the backlight module 120. In this way, although the image color is not rich, a power saving effect is achieved, and a usage time of the display apparatus 100 is prolonged.

Figure 7:
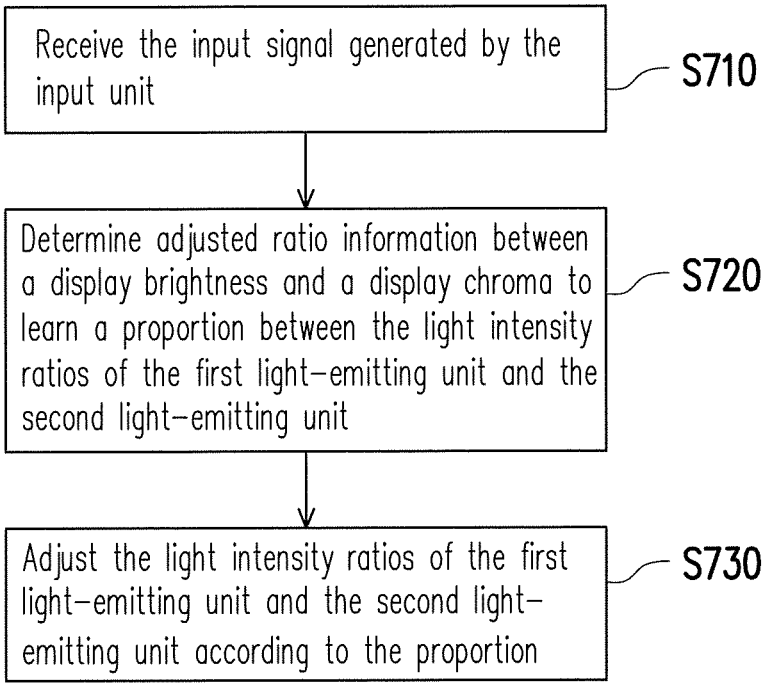
FIG. 7 is a flowchart illustrating a method for controlling a backlight module according to another embodiment of the invention.
Figure 8:
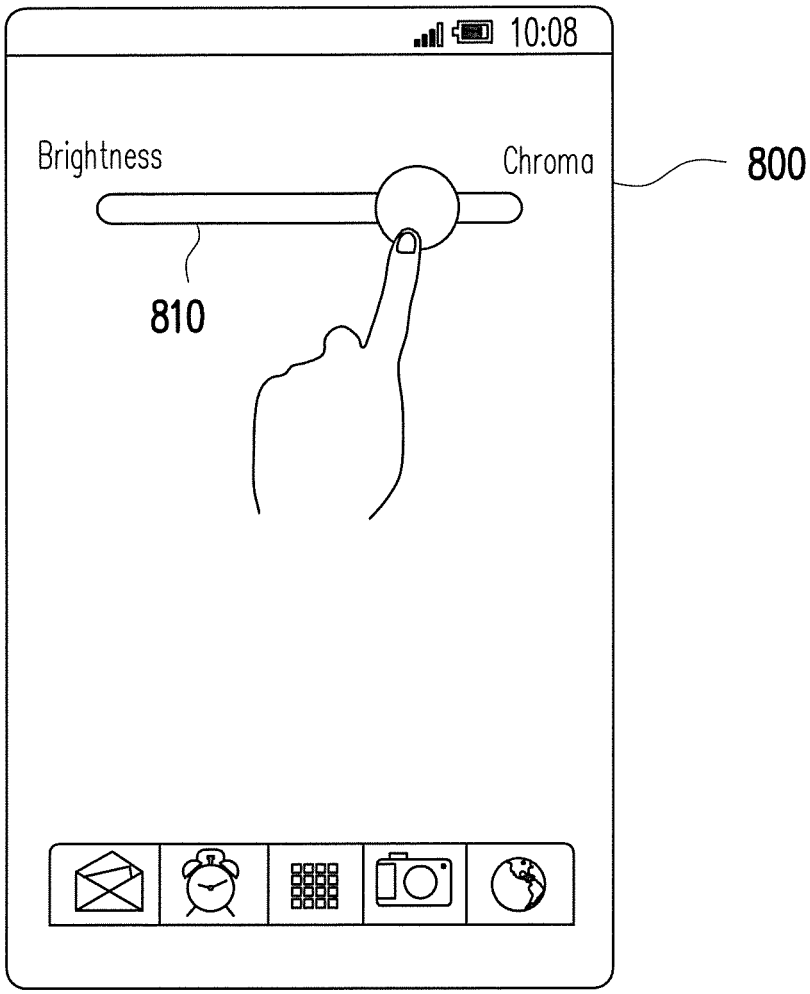
FIG. 8 is a schematic diagram of a touch screen when an input unit of the backlight module is a display brightness-chroma adjusting module according to another embodiment of the invention.

FIG. 7 is a flowchart illustrating a method for controlling a backlight module according to another embodiment of the invention. FIG. 8 is a schematic diagram of a touch screen when the input unit 130 of the backlight module is a display brightness-chroma adjusting module according to the embodiment of FIG. 7. Referring to FIG. 1, FIG. 7 and FIG. 8, in the embodiment, the input unit 130 is a display brightness-chroma adjusting module. For example, a slide bar 810 with one end of brightness and another end of chroma can be displayed on a touch screen 800 of FIG. 8 to implement adjustment of display brightness and display chroma. In the embodiment, the input unit 130 is, for example, a touch module or a touch sensor, and the user can directly touch the touch screen 800 to adjust a ratio between the display brightness and the display chroma. For example, the user slides the slide bar 810 through a touching method, or presses plus or minus symbols or direction arrows on the screen, and adjusted ratio information is taken as the input signal S. The processing unit 140 receives the ratio information, and makes a proportion between the light intensity ratios of the first light-emitting unit 151 and the second light-emitting unit 152 to be equal to the ratio information. Referring to FIG. 7, in step S710, the processing unit 140 receives the input signal S generated by the input unit 130. In step S720, the processing unit 140 determines the adjusted ratio information between the display brightness and the display chroma in the input signal S to learn the proportion between the light intensity ratios of the first light-emitting unit 151 and the second light-emitting unit 152. In step S730, the processing unit 140 adjusts the light intensity ratios of the first light-emitting unit 151 and the second light-emitting unit 152 according to the proportion. In this way, the display brightness and the display chroma of the image can be directly adjusted by the user, by which freedom for operating the display image is improved.

In another embodiment of the invention, the input unit 130 simultaneously integrates the functions of the data comparison module, the brightness determination module, the electric quantity monitoring module and the display brightness-chroma adjusting module, and an execution result of the display brightness-chroma adjusting module that is directly operated by the user has a highest priority, an execution result of the electric quantity monitoring module based on the remained electric quantity takes a second place, an execution result of the brightness determination module based on the ambient brightness takes a third place, and an execution result of the data comparison module based on application execution has the lowest priority. In other words, when the input unit 130 executes the function of the display brightness-chroma adjusting module, if the execution result thereof is conflicted with the execution results of the data comparison module, the brightness determination module and the electric quantity monitoring module, the input unit 130 still generates the input signal S according to the execution result of the display brightness-chroma adjusting module, and accordingly adjusts the first light-emitting unit 151 and the second light-emitting unit 152. Comparatively, when the input unit 130 executes the function of the data comparison module, if the execution result thereof is conflicted with the execution results of the brightness determination module, the electric quantity monitoring module and the display brightness-chroma adjusting module, the input unit 130 does not generate the input signal S. However, the invention is not limited thereto, the user can set and store a priority sequence of the execution results of the brightness determination module, the brightness determination module, the electric quantity monitoring module and the display brightness-chroma adjusting module by himself. In another embodiment of the invention, the input unit 130 simultaneously integrates the functions of at least two of the data comparison module, the brightness determination module, the electric quantity monitoring module and the display brightness-chroma adjusting module, and priorities of the execution results of the integrated modules can be adjusted according to user's requirement, which is not limited by the invention.

In summary, according to the display apparatus and the method for controlling the backlight module thereof, the display apparatus capable of adjusting the display brightness and the display chroma thereof can be used according to conditions of applications, environmental brightness, remaining power and user's preference, etc. In this way, the display apparatus is capable of effectively adjusting the image brightness and color performance in allusion to different usage situations, so as to suitably decrease the power consumption and the hardware cost.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the disclosure is intended to be dedicated to the public regardless of whether the element or component is explicitly recited in the following claims.

What is claimed is:

1. A display apparatus, comprising:

a backlight module, a light-emitting device of the backlight module comprising a first light-emitting unit and a second light-emitting unit, wherein a photoelectric conversion efficiency of the first light-emitting unit is higher than a photoelectric conversion efficiency of the second light-emitting unit, and a covering color gamut of the second light-emitting unit is larger than a covering color gamut of the first light-emitting unit;

an input unit, generating an input signal; and a processing unit, coupled to the input unit, configured to receive the input signal generated by the input unit, and coupled to the backlight module, and dynamically adjusting respective light intensity ratios of the first light-emitting unit and the second light-emitting unit according to the received input signal, wherein the input unit comprises a brightness determination module, and the brightness determination module determines a brightness of an ambient environment of the display apparatus and provides brightness information of the ambient environment to serve as the input signal, wherein the processing unit receives the brightness information, and when the brightness information is lower than a brightness predetermined value, the processing unit adjusts the light intensity ratio of the second light-emitting unit to serve as a brightness of the backlight module, and disables the first light-emitting unit; and when the brightness information is higher than the brightness predetermined value, the processing unit adjusts the light intensity ratio of the second light-emitting unit to the maximum, and dynamically adjusts the light intensity ratio of the first light-emitting unit to serve as the brightness of the backlight module.

2. The display apparatus as claimed in claim 1, further comprising:

a storage unit, coupled to the processing unit, and configured to store at least one light intensity mode information, wherein each light intensity mode information comprises respective predetermined light intensity ratios of the first light-emitting unit and the second light-emitting unit.

3. The display apparatus as claimed in claim 1, wherein the display apparatus is disposed in an electronic device, the electronic device comprises at least one application, wherein the input unit further comprises a data comparison module, when the electronic device executes the application, the data comparison module determines a display content of the application, and generates the input signal according to a determination result, and the processing unit selects at least one corresponding light intensity mode according to the input signal, and adjusts the respective light intensity ratios of the first light-emitting unit and the second light-emitting unit according to the at least one corresponding light intensity mode.

4. The display apparatus as claimed in claim 3, wherein the application in the electronic device sets a light intensity mode flag, and the input signal comprises the light intensity mode flag corresponding to the application, and the processing unit selects the at least one corresponding light intensity mode according to the light intensity mode flag of the input signal.

5. The display apparatus as claimed in claim , wherein when the display content of the application mainly comprises text information, the processing unit adjusts the light intensity ratio of the first light-emitting unit to the maximum, and adjusts the light intensity ratio of the second light-emitting unit to the minimum.

6. The display apparatus as claimed in claim 3, wherein when the display content of the application mainly comprises image information, the processing unit adjusts the light intensity ratio of the first light-emitting unit to the minimum, and adjusts the light intensity ratio of the second light-emitting unit to the maximum.

7. The display apparatus as claimed in claim 1, wherein the input unit further comprises an electric quantity monitoring module of the display apparatus configured to generate electric quantity information of the display apparatus to serve as the input signal, wherein the processing unit receives the electric quantity information, and when the electric quantity information is lower than an electric quantity predetermined value, the processing unit adjusts the light intensity ratio of the first light-emitting unit to serve as a brightness of the backlight module, and disables the second light-emitting unit.

8. The display apparatus as claimed in claim 1, wherein the input unit further comprises a display brightness-chroma adjusting module configured to provide ratio information between a display brightness and a display chroma to serve as the input signal, wherein the processing unit receives the ratio information, and makes a proportion between the light intensity ratios of the first light-emitting unit and the second light-emitting unit to be equal to the ratio information.

9. A method for controlling a display apparatus, the display apparatus having a backlight module, comprising:

receiving an input signal generated by an input unit, wherein the backlight module comprises a first light-emitting unit and a second light-emitting unit, and a photoelectric conversion efficiency of the first light-emitting unit is higher than a photoelectric conversion efficiency of the second light-emitting unit, and a covering color gamut of the second light-emitting unit is larger than a covering color gamut of the first light-emitting unit;

determining a brightness of an ambient environment of the display apparatus, and generating the input signal according to brightness information of the ambient environment; and dynamically adjusting respective light intensity ratios of the first light-emitting unit and the second light-emitting unit according to the received input signal, wherein the step of dynamically adjusting the respective light intensity ratios of the first light-emitting unit and the second light-emitting unit comprises:

adjusting the light intensity ratio of the second light-emitting unit to serve as a brightness of the backlight module, and disabling the first light-emitting unit when the brightness information is lower than a brightness predetermined value; and adjusting the light intensity ratio of the second light-emitting unit to the maximum, and dynamically adjusting the light intensity ratio of the first light-emitting unit to serve as the brightness of the backlight module when the brightness information is higher than the brightness predetermined value.

10. The method for controlling the display apparatus as claimed in claim 9, wherein the backlight module is disposed in an electronic device, and the step of dynamically adjusting the respective light intensity ratios of the first light-emitting unit and the second light-emitting unit comprises:

determining a display content of an application to generate the input signal when the electronic device executes the application;

selecting at least one corresponding light intensity mode according to the input signal; and adjusting the respective light intensity ratios of the first light-emitting unit and the second light-emitting unit according to the at least one corresponding light intensity mode, wherein each of the at least one light intensity mode information comprises respective predetermined light intensity ratios of the first light-emitting unit and the second light-emitting unit.

11. The method for controlling the display apparatus as claimed in claim 10, wherein the application in the electronic device sets a light intensity mode flag, and the input signal comprises the light intensity mode flag corresponding to the application, and the step of selecting the at least one corresponding light intensity mode according to the input signal comprises:

selecting the at least one corresponding light intensity mode according to the light intensity mode flag of the input signal.

12. The method for controlling the display apparatus as claimed in claim 10, wherein the step of adjusting the respective light intensity ratios of the first light-emitting unit and the second light-emitting unit comprises:

adjusting the light intensity ratio of the first light-emitting unit to the maximum, and adjusting the light intensity ratio of the second light-emitting unit to the minimum when the display content of the application mainly comprises text information.

13. The method for controlling the display apparatus as claimed in claim 10, wherein the step of adjusting the respective light intensity ratios of the first light-emitting unit and the second light-emitting unit comprises:

adjusting the light intensity ratio of the first light-emitting unit to the minimum, and adjusting the light intensity ratio of the second light-emitting unit to the maximum when the display content of the application mainly comprises image information.

14. The method for controlling the display apparatus as claimed in claim 9, wherein the input signal is further generated according to electric quantity information of the backlight module, and the step of dynamically adjusting the respective light intensity ratios of the first light-emitting unit and the second light-emitting unit further comprises:

adjusting the light intensity ratio of the first light-emitting unit to serve as a brightness of the backlight module, and disabling the second light-emitting unit when the electric quantity information is lower than an electric quantity predetermined value.

15. The method for controlling the display apparatus as claimed in claim 9, wherein the input signal is further generated according to ratio information between a display brightness and a display chroma, and the step of dynamically adjusting the respective light intensity ratios of the first light-emitting unit and the second light-emitting unit further comprises:

receiving the ratio information, and making a proportion between the light intensity ratios of the first light-emitting unit and the second light-emitting unit to be equal to the ratio information.

* * * * *